US010661414B2

(12) United States Patent
Moyer et al.

(10) Patent No.: US 10,661,414 B2
(45) Date of Patent: May 26, 2020

(54) TOOL WITH HANDLE OFFSETS

(71) Applicant: Snap-on Incorporated, Kenosha, WI (US)

(72) Inventors: Douglas A. Moyer, Racine, WI (US); Daniel M. Eggert, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 222 days.

(21) Appl. No.: 15/901,051

(22) Filed: Feb. 21, 2018

(65) Prior Publication Data

US 2019/0255683 A1 Aug. 22, 2019

(51) Int. Cl.
*B25B 7/10* (2006.01)

(52) U.S. Cl.
CPC ..... *B25B 7/10* (2013.01)

(58) Field of Classification Search
CPC .... B25B 7/06; B25B 7/08; B25B 7/10; B25B 13/50
See application file for complete search history.

(56) References Cited

U.S. PATENT DOCUMENTS

| | | | |
|---|---|---|---|
| 79,642 | A | 7/1868 | Evarts |
| 1,950,362 | A | 2/1932 | Manning |
| 2,444,135 | A | 1/1944 | Kress |
| 2,557,296 | A | 2/1948 | Kress |
| 2,622,464 | A | 12/1952 | Daugherty |
| 3,176,551 | A | 4/1965 | Hansen |
| 3,768,346 | A | 10/1973 | Burthardt |
| 3,777,741 | A | 12/1973 | Beaston |
| 3,824,882 | A | 7/1974 | Burthardt |
| 3,894,451 | A | 7/1975 | Putsch |
| 4,271,732 | A | 6/1981 | Vaughan, Jr. |
| 4,438,669 | A | 3/1984 | Hastings |
| 4,581,960 | A | 4/1986 | Putsch et al. |
| 4,603,607 | A | 6/1986 | Schaffner |
| 4,662,252 | A | 5/1987 | Warheit |
| 4,719,827 | A | 1/1988 | Igarashi |
| 4,726,265 | A | 2/1988 | Reich |
| 4,901,609 | A | 2/1990 | Crum |

(Continued)

FOREIGN PATENT DOCUMENTS

| | | |
|---|---|---|
| CN | 104023917 | 9/2014 |
| DE | 933860 | 10/1955 |

(Continued)

OTHER PUBLICATIONS

Examination Report for Australian Application No. 2018222987 dated May 10, 2019, 5 pages.

(Continued)

*Primary Examiner* — David B. Thomas
(74) *Attorney, Agent, or Firm* — Seyfarth Shaw LLP

(57) ABSTRACT

Disclosed is a tool, such as pliers, with handle offsets and stop features. In an embodiment, the tool has a minimum of about 0.50 inches of clearance between handles in an area where a user's index finger contacts the handles. This is accomplished by offsetting upper and lower handles of the tool. For example, the lower handle may be offset about 1.10 inches from a pivot point between the handles. Similarly, an end of the upper handle may be offset by about 1.150 inches from the pivot point when jaws of the tool are adjusted to a closed position.

14 Claims, 11 Drawing Sheets

(56) References Cited

U.S. PATENT DOCUMENTS

| | | | | |
|---|---|---|---|---|
| 4,922,770 | A * | 5/1990 | Dlugolecki | B25B 7/10 81/325 |
| 4,934,222 | A * | 6/1990 | Rittmann | B25B 7/00 81/415 |
| 4,957,020 | A | 9/1990 | Monceret | |
| 5,020,399 | A | 6/1991 | Annis et al. | |
| 5,060,543 | A | 10/1991 | Warheit | |
| 5,134,908 | A | 8/1992 | Fisher | |
| 5,176,049 | A | 1/1993 | Neff | |
| 5,291,810 | A * | 3/1994 | Lins | B25B 7/10 81/393 |
| 5,351,584 | A | 10/1994 | Warheit | |
| D398,497 | S | 9/1998 | Gomas | |
| D405,333 | S | 2/1999 | Wrigley | |
| 6,000,303 | A | 12/1999 | Chang | |
| D422,863 | S | 4/2000 | Warner et al. | |
| 6,101,908 | A | 8/2000 | Azkona | |
| 6,199,459 | B1 | 3/2001 | Azkona | |
| 6,327,943 | B1 | 12/2001 | Wrigley et al. | |
| 6,341,545 | B1 | 1/2002 | Gomas | |
| 6,467,380 | B1 | 10/2002 | Azkona | |
| 6,513,245 | B1 | 2/2003 | Aubriot | |
| D494,439 | S | 8/2004 | Levine et al. | |
| 6,880,434 | B2 * | 4/2005 | Nouvel | B25B 7/10 81/409 |
| 7,100,480 | B2 * | 9/2006 | Engvall | B25B 7/10 81/391 |
| 7,182,004 | B1 | 2/2007 | Wang | |
| D543,812 | S | 6/2007 | Burry et al. | |
| 7,406,898 | B1 | 8/2008 | Hall, Jr. | |
| 7,503,243 | B2 | 3/2009 | Putsch | |
| 7,614,324 | B2 * | 11/2009 | Bocquet | B25B 7/18 81/355 |
| D607,703 | S | 1/2010 | Pagliari | |
| 7,676,873 | B1 | 3/2010 | Simms | |
| 8,661,948 | B2 * | 3/2014 | DeBaker | B21K 5/00 81/405 |
| 8,677,866 | B2 * | 3/2014 | Steele | B25B 7/10 72/413 |
| 8,707,833 | B1 | 4/2014 | Gedeon | |
| RE45,680 | E | 9/2015 | Nouvel | |
| 9,370,857 | B2 * | 6/2016 | Guenther | B25B 7/10 |
| 9,457,484 | B2 | 10/2016 | Schultes | |
| 9,687,965 | B2 * | 6/2017 | DeBaker | B21K 5/00 |
| 9,943,945 | B2 * | 4/2018 | Chen | B25B 7/10 |
| 10,137,559 | B2 * | 11/2018 | Debaker | B21K 5/00 |
| 2004/0016325 | A1 | 1/2004 | Smith | |
| 2005/0217439 | A1 | 10/2005 | Macor | |
| 2008/0236345 | A1 | 10/2008 | Bocquet et al. | |
| 2010/0064861 | A1 | 3/2010 | Herrmann | |
| 2012/0111157 | A1 * | 5/2012 | Qiu | B25B 7/10 81/409 |
| 2014/0053694 | A1 * | 2/2014 | Lin Wu | B25B 7/10 81/416 |
| 2015/0196993 | A1 | 7/2015 | Reckhart | |
| 2016/0288298 | A1 * | 10/2016 | Chen | B25B 7/10 |
| 2017/0066112 | A1 * | 3/2017 | Herrmann | B25B 7/10 |
| 2018/0021926 | A1 * | 1/2018 | Wang | B25B 7/12 81/409.5 |
| 2018/0281156 | A1 * | 10/2018 | Chen | B25B 7/10 |

FOREIGN PATENT DOCUMENTS

| | | |
|---|---|---|
| DE | 2619651 | 11/1977 |
| DE | 3303368 | 10/1990 |
| DE | 29920171 | 2/2000 |
| DE | 10042288 | 3/2002 |
| DE | 102004022943 | 8/2014 |
| EP | 3290169 | 3/2018 |
| GB | 2479982 A | 11/2011 |
| JP | 409001468 | 1/1997 |
| JP | 2010017839 | 1/2010 |
| JP | 2011152398 | 8/2011 |
| JP | 2011230233 | 11/2011 |
| TW | M442906 | 12/2012 |
| TW | 201318787 | 5/2013 |
| TW | M548050 | 9/2017 |
| WO | 2012061419 | 5/2012 |

OTHER PUBLICATIONS

United Kingdom Combined Search and Examination Report for Application No. GB1814117.6 dated Feb. 15, 2019, 7 pages.
Taiwan Office Action for Application No. 108105718, dated Sep. 4, 2019, 9 pages.
Canadian Office Action for Application No. 3,020,388, dated Nov. 15, 2019, 4 pages.

* cited by examiner

TOOL WITH HANDLE OFFSETS

TECHNICAL FIELD OF THE INVENTION

The present invention relates generally to tools, such as pliers. More particularly, the present invention relates to a tool with handle offsets for pinch point reduction.

BACKGROUND OF THE INVENTION

Hand tools have been around for years in many forms. To increase the usefulness of some hand tools, features were developed to allow the tools to adjust to varying workpiece sizes. That is, instead of changing to a bigger or smaller tool, a single tool could be adjusted to accommodate a larger or smaller sized workpiece, saving on time and the number of tools required for any given job. However, current tools typically allow handles of the tool to close together such that a user may pinch his/her fingers between the handles.

SUMMARY OF THE INVENTION

The present invention broadly comprises a tool, such as pliers, with handle offsets and stop features. In an embodiment, the tool has a minimum of about 0.50 inches of clearance between handles in an area where a user's index finger contacts the handles. This is accomplished by offsetting upper and lower handles of the tool. For example, the lower handle may be offset about 1.10 inches from a pivot point between the handles. Similarly, an end of the upper handle may be offset by about 1.150 inches from the pivot point when jaws of the tool are adjusted to a closed position.

In an embodiment, the present invention includes a tool including a first portion having a first jaw portion and a first handle portion, and a second portion having a second jaw portion and a second handle portion. The second portion is coupled to the first portion at a pivot point, and the second jaw portion is aligned with the first jaw portion. A first outer edge of the first handle portion is offset from the pivot point by a first length, and a second outer edge of the second handle portion is offset from the pivot point by a second length. The first and second lengths provide at least about 0.50 inches of clearance between the first and second handle portions at a gripping area.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
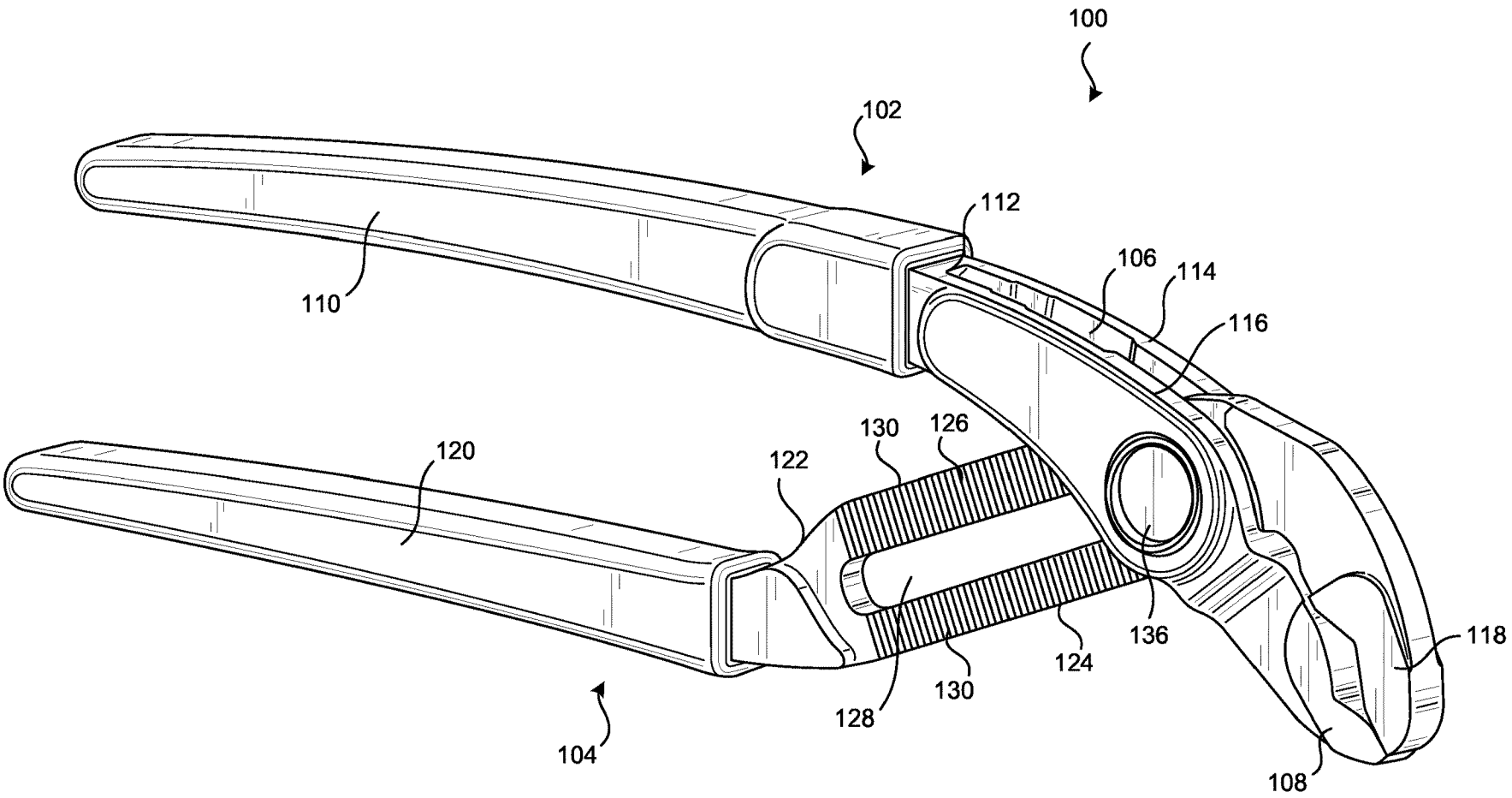
FIG. 1 is a side perspective view of a tool according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present invention broadly comprises a tool, such as pliers, with handle offsets and stop features. In an embodiment, the tool has a minimum of about 0.50 inches of clearance between handles in an area where a user's index finger contacts the handles. This is accomplished by offsetting upper and lower handles of the tool. For example, the lower handle may be offset about 1.10 inches from a pivot point between the handles. Similarly, an end of the upper handle may be offset by about 1.150 inches from the pivot point when jaws of the tool are adjusted to a closed position.

Referring to FIGS. 1-8, a tool 100, such as pliers, includes a first portion 102 and a second portion 104. The first portion 102 includes a slot 106 adapted to receive the second portion 104. The first portion 102 also includes a first jaw portion 108 at a first end of the first portion 102, a first handle portion 110 at a second end of the first portion 102 opposite the first jaw portion 108, and a first adjustment portion 112 between the first jaw portion 108 and first handle portion 110. The first adjustment portion 112 includes first and second opposing side portions 114, 116 that form the slot 106 there between.

The second portion 104 includes a second jaw portion 118 at a first end of the second portion 104, a second handle portion 120 at a second end of the second portion 104 opposite the second jaw portion 118, and a second adjustment portion 122 between the second jaw portion 118 and second handle portion 120. The second adjustment portion 122 includes first and second side portions 124, 126 that form an elongated slot 128 there between. As illustrated in FIG. 1, each of the first and second side portions 124, 126 includes teeth 130 on one side of the respective first and second side portions 124, 126. In an embodiment, the teeth 130 are spaced at 0.098 inches from one another and the elongated slot 128 is sized to provide a maximum jaw opening (i.e., distance between the first and second jaw portions 108, 118) of 2.24 inches.

The second portion 104 is disposed in the slot 106 of the first portion 102, and the elongated slot 128 is aligned with an aperture 132 in the first adjustment portion 112 of the first portion 102. An adjustment member 134 couples the first and second portions 102, 104 together and forms a pivot point, allowing the first and second portions 102, 104 to pivot with respect to each other to open and close the first and second jaw portions.

Figure 2:
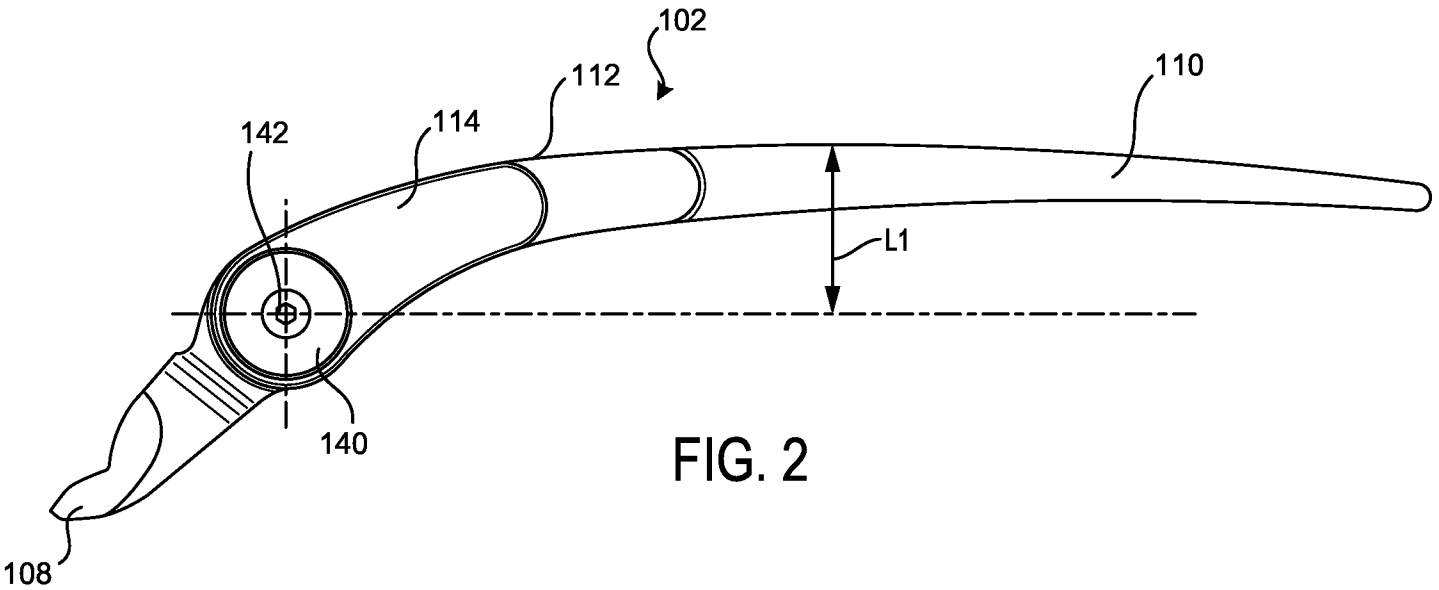
FIG. 2 is a side view of a first portion of the tool of FIG. 1.
Figure 3:
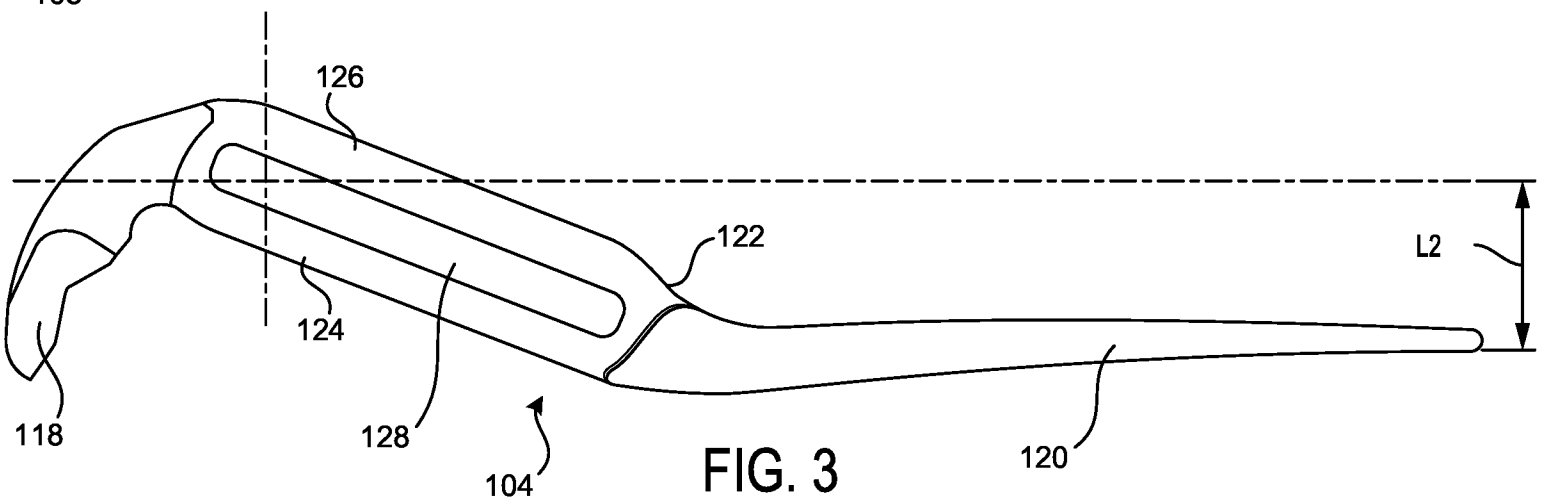
FIG. 3 is a side view of a second portion of the tool of FIG. 1.
Figure 4:
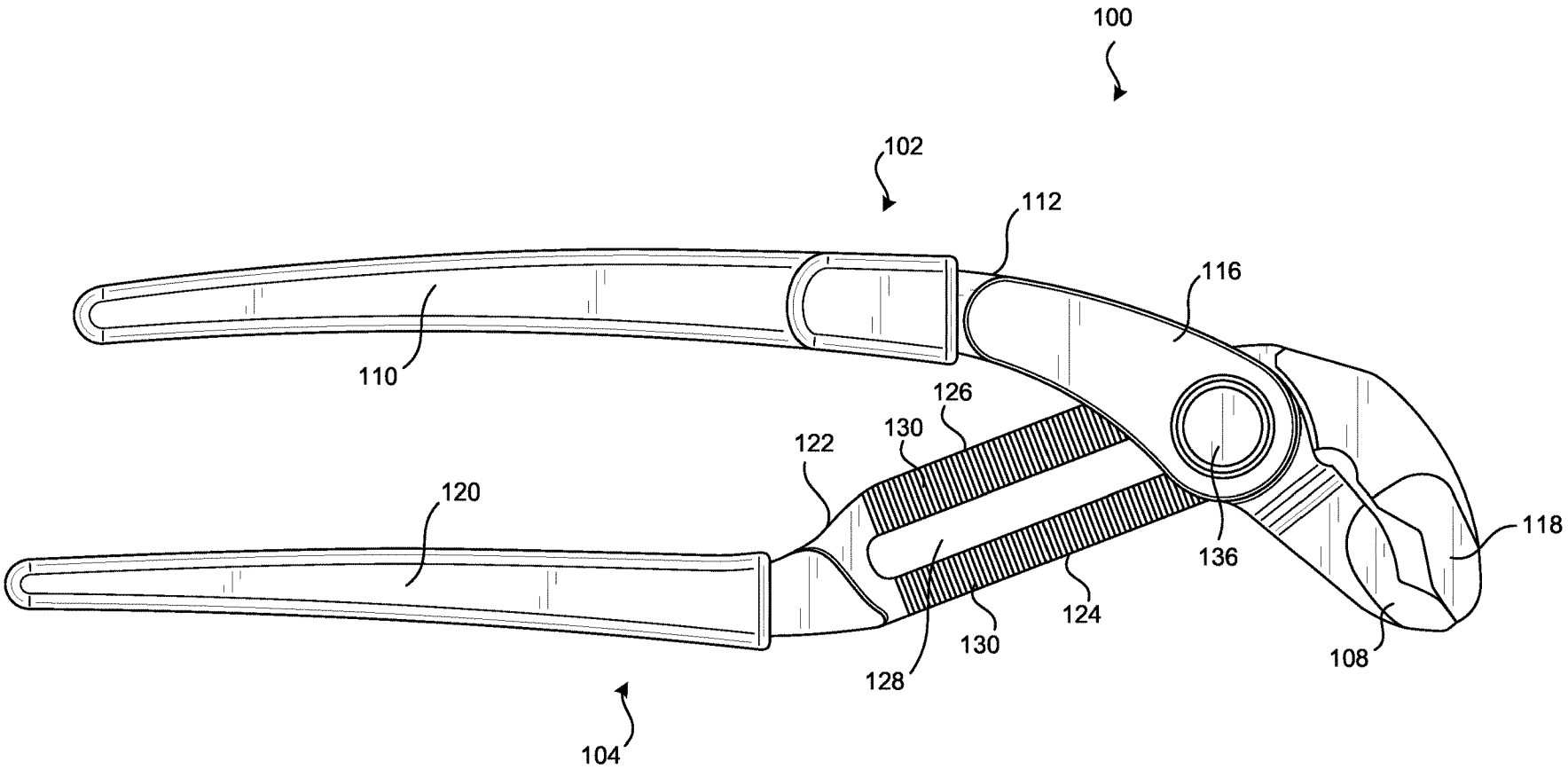
FIG. 4 is a first side view of the tool of FIG. 1 with jaws of the tool in a first position.

Referring to FIG. 2, the first portion 102 has an offset length L1. Accordingly, an outside edge of the first handle portion 110 is offset from the pivot point by a length L1. In an embodiment, the length L1 is about 1.10 inches. Similarly, referring to FIG. 3, the second portion 104 has an offset length L2. Accordingly, an outside edge of the second handle portion 120 is offset from the pivot point by a length L2. In an embodiment, the length L2 is about 1.15 inches.

The offset lengths L1 and L2 provide at least about 0.50 inches of clearance between first and second handle portions 110, 120 in an area where a user's index finger contacts the first and second handle portions 110, 120. This reduces a chance of a user pinching his/her finger(s) or hand(s) between the first and second handle portions 110, 120 during use.

Figure 5:
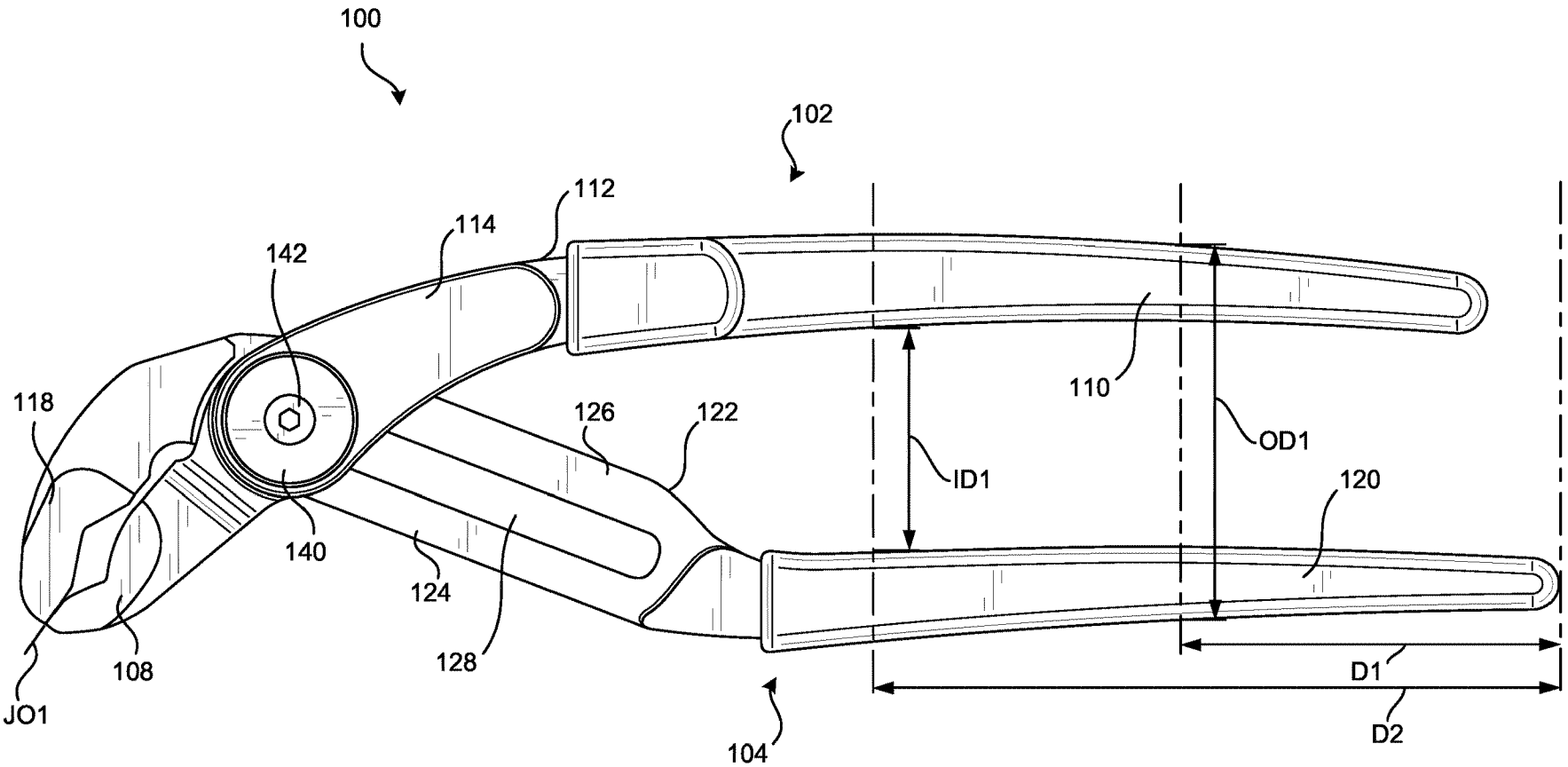
FIG. 5 is a second side view of the tool of FIG. 1 with jaws of the tool in the first position.

For example, FIG. 5, illustrates the first and second jaw portions 108, 118 in a first position. In the first position, the first and second jaw portions 108, 118 are closed, and have a first jaw opening distance (JO1) of about 0 inches. The first and second handle portions 110, 120 also have an outside distance (OD1) between exteriors sides of the first and second handle portions 110, 120 of about 2.44 inches, and an inside distance (ID1) between interior sides of the first and second handle portions 110, 120 of about 1.46 inches. The outside distance (OD1) is measured at a distance (D1) of about 2.5 inches from an end of the second handle portion 120. The outside distance (OD1) is measured at the distance (D1), because the distance (D1) is an approximate location of a center of a user's grip during use of the tool 100. Similarly, the inside distance (ID1) is measured at a distance (D2) of about 4.2 inches from an end of the second handle portion 120. The distance (D2) is an approximate location of an index finger of a user's grip during use of the tool 100.

Figure 6:
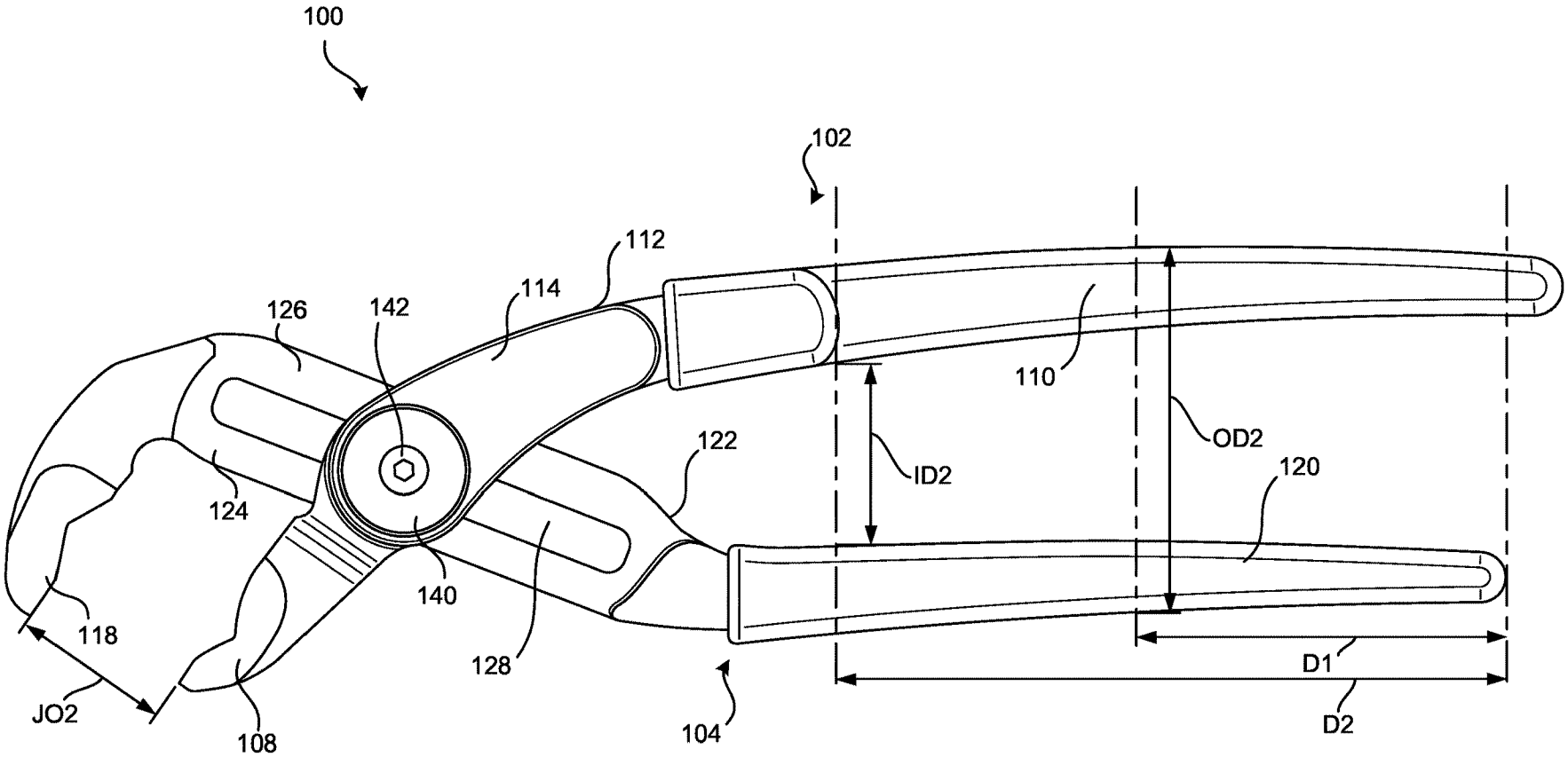
FIG. 6 is a side view of the tool of FIG. 1 with jaws of the tool in a second position.

Referring to FIG. 6, the first and second jaw portions 108, 118 are in a second position. In the second position, the first and second jaw portions 108, 118 have a second jaw opening distance (JO2) of about 1.37 inches. The first and second handle portions 110, 120 also have an outside distance (OD2) between exteriors sides of the first and second handle portions 110, 120 of about 2.32 inches, and an inside distance (ID2) between interior sides of the first and second handle portions 110, 120 of about 1.09 inches.

Figure 7:
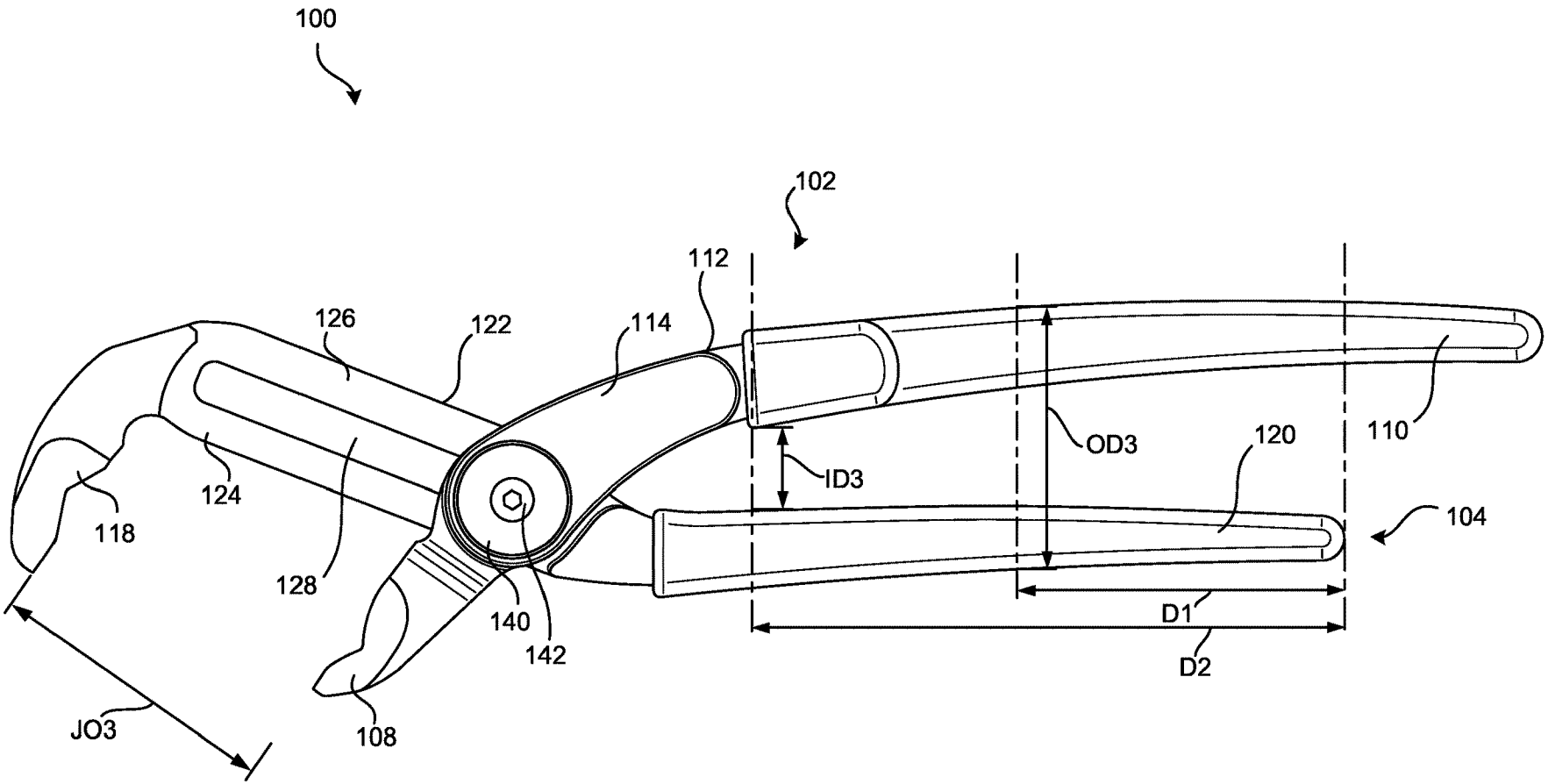
FIG. 7 is a side view of the tool of FIG. 1 with jaws of the tool in a third position.

Referring to FIG. 7, the first and second jaw portions 108, 118 are in a third position. In the third position, the first and second jaw portions 108, 118 have a third jaw opening distance (JO3) of about 2.24 inches. The first and second handle portions 110, 120 also have an outside distance (OD3) between exteriors sides of the first and second handle portions 110, 120 of about 1.96 inches, and an inside distance (ID3) between interior sides of the first and second handle portions 110, 120 of about 0.63 inches.

Accordingly, the offset lengths L1 and L2 provide at least about 0.50 inches of clearance between first and second handle portions 110, 120 in an area where a user's index finger contacts the first and second handle portions 110, 120, (such as a gripping area at distance (D2)) in each of the first, second and third positions. This reduces a chance of a user pinching his/her finger(s) or hand(s) between the first and second handle portions 110, 120 during use.

Figure 8:
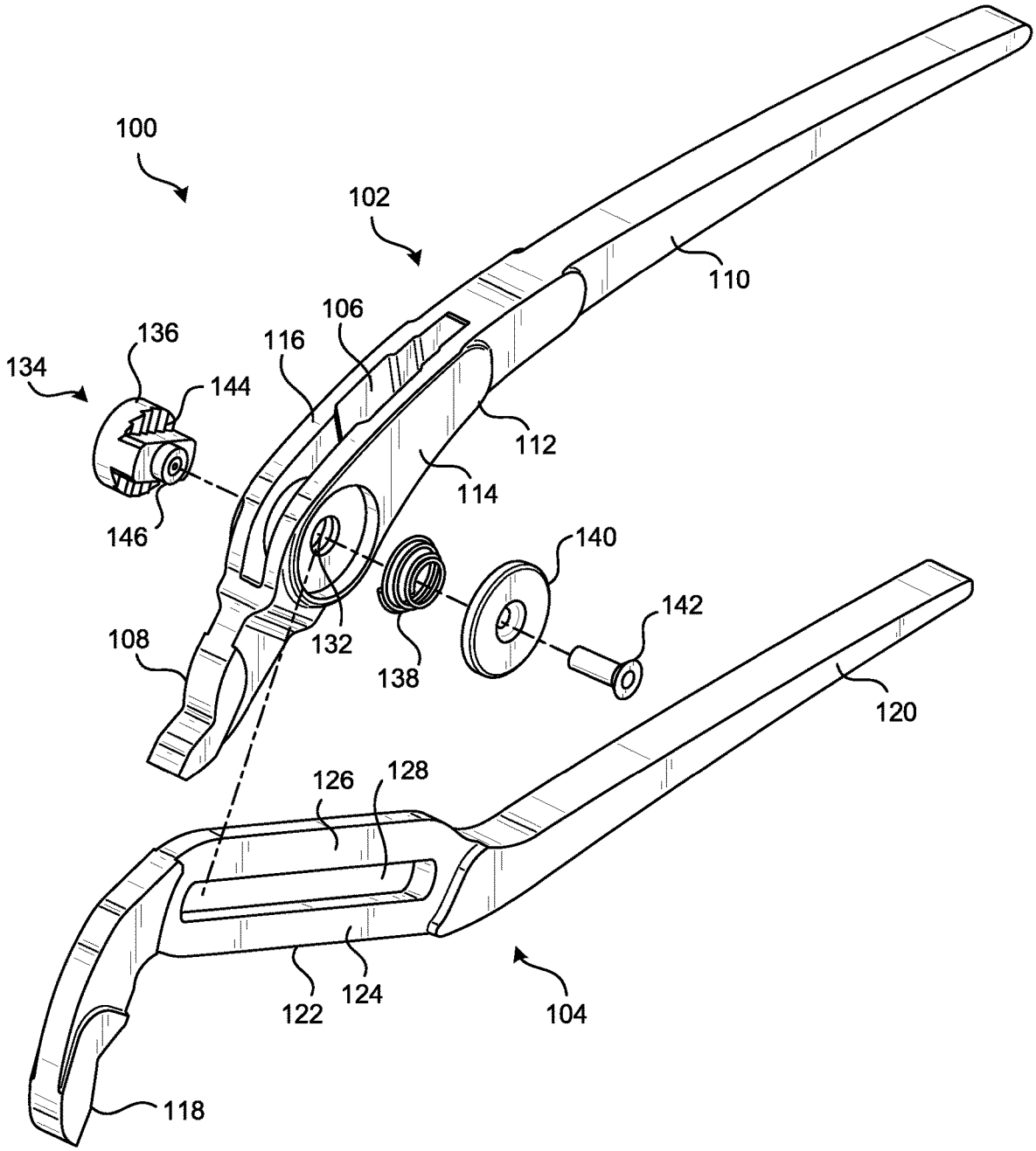
FIG. 8 is an exploded view of the tool of FIG. 1.

Referring to FIG. 8, the tool 100 also includes an adjustment member 134. The adjustment member includes a pawl 136, a bias member 138, a button 140, and a fastener 142. The pawl 136 includes teeth 144 adapted to mate with and engage teeth 130 on the first and second side portions 124, 126, and a fastener receiving portion 146 adapted to mate with the fastener 142. The pawl 136 is disposed in the aperture 132 adjacent an external surface of the second side portion 116. The pawl 136 may be keyed to the aperture to prevent rotation of the pawl 136 with respect to the first portion 102. The bias member 138 (which may be a spring) is disposed in a recess disposed in the first side portion 114. The button 140 is disposed adjacent the bias member 138 in the recess. The fastener 142 extends through the button 140 and bias member 138, and is coupled to the fastener receiving portion 146 of the pawl 136. The bias member 138 biases the button 140 and fastener 142 outwardly away from the first side portion 114, thereby causing the teeth 144 of pawl 136 to engage the teeth 130. When the button 140 is depressed against the bias force of the bias member 138, the teeth 144 of pawl 136 disengage the teeth 130.

In operation, a user may adjust the size of the opening between the first and second jaw portions 108, 118 by moving or sliding the first portion 102 with respect to the second portion 104 along elongated slot 128, or vice versa. This moves a pivot point between the first and second portions 102, 104 and defined by the adjustment member 134. For example, to make a size of the opening smaller, the first portion 102 may be moved or slid to an end of the slot 128 proximal to the second jaw portion 118. When the size of the opening is made smaller, the teeth 144 of pawl 136 may ratchet with respect to the teeth 130, thereby allowing the size of the opening to be made smaller without having to depress the button. To make a size of the opening larger, the button may be depressed, thereby disengaging teeth 144 of pawl 136 from teeth 130. While the button is depressed, the first portion 102 may be moved or slid towards an end of the slot 128 distal to the second jaw portion 118.

The spacing of the teeth 144 may be about 0.098 inches or smaller, and the tool may provide a maximum jaw opening of about 2.24 inches. This provides more adjustment positions and allows more teeth 144 to be engaged with teeth 130 at all positions. For example, the size of the opening between the first and second jaw portions 108, 118 may be adjusted in 0.098 inch increments by moving or sliding the first portion 102 with respect to the second portion 104 along elongated slot 128.

Referring to FIGS. 9-12, a tool 200, such as pliers, is illustrated. The tool 200 is similar to the tool 100, except that the teeth extend into the slot. For example, the tool 200 includes a first portion 202 and a second portion 204. The first portion 202 includes a slot 206 adapted to receive the second portion 204. The first portion 202 also includes a first jaw portion 208 at a first end of the first portion 202, a first handle portion 210 at a second end of the first portion 202 opposite the first jaw portion 208, and a first adjustment portion 212 between the first jaw portion 208 and first handle portion 210. The first adjustment portion 212 includes first and second opposing side portions 214, 216 that form the slot 206 there between.

Figure 9:
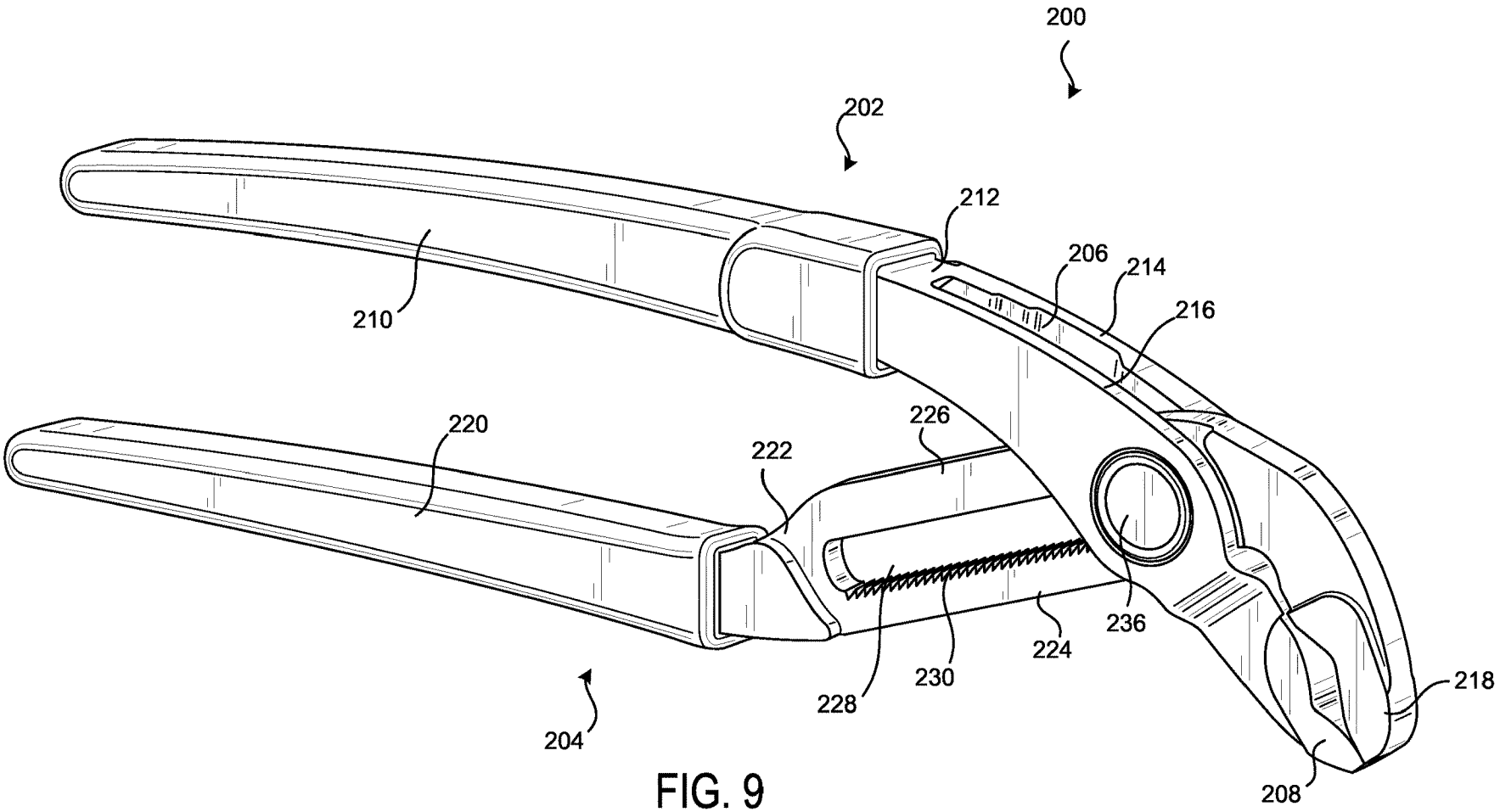
FIG. 9 is a side perspective view of another tool according to an embodiment of the present invention.
Figure 10:
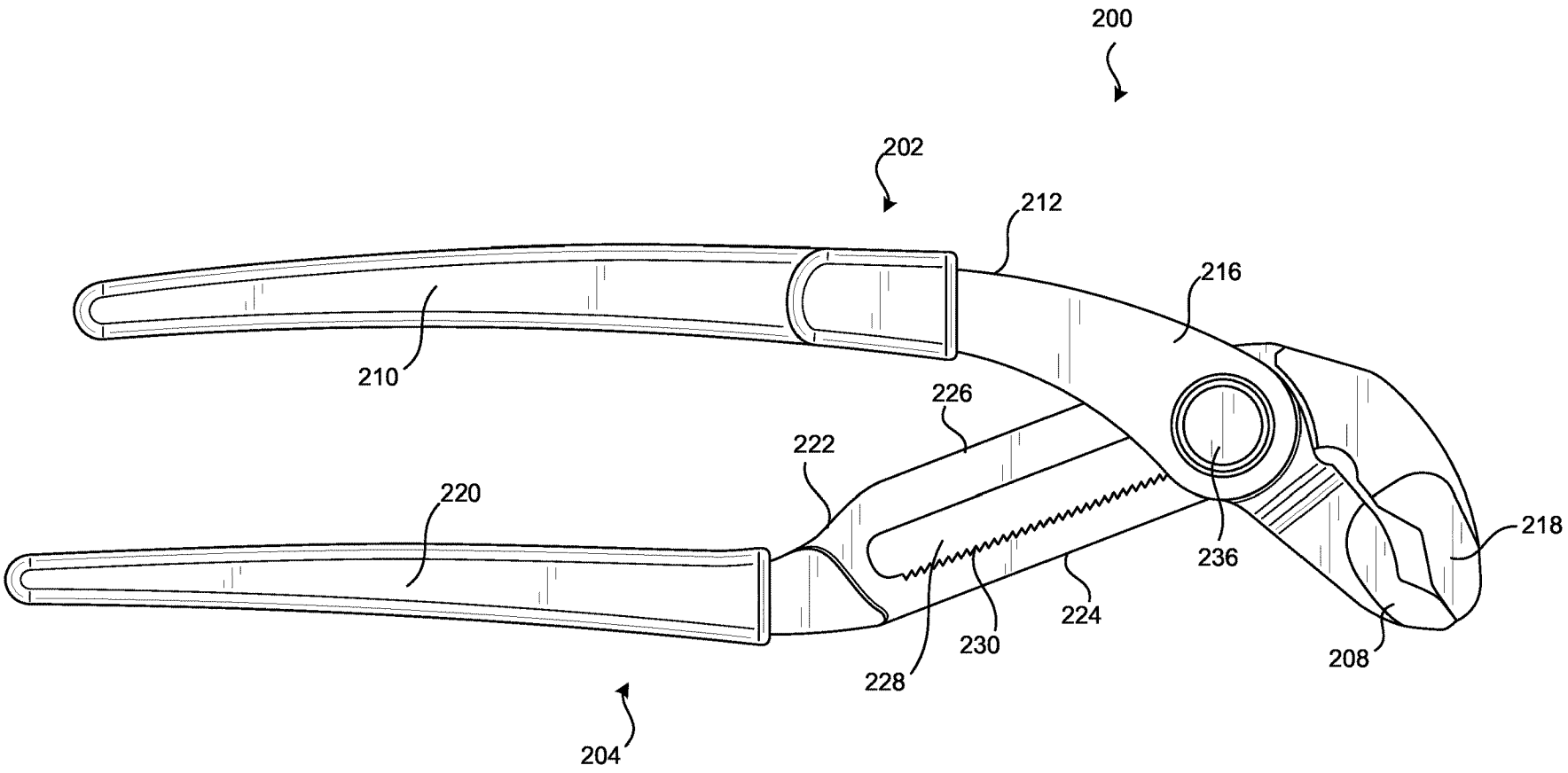
FIG. 10 is a first side view of the tool of FIG. 9 with jaws of the tool in a first position.

The second portion 204 includes a second jaw portion 218 at a first end of the second portion 204, a second handle portion 220 at a second end of the second portion 204 opposite the second jaw portion 218, and a second adjustment portion 222 between the second jaw portion 218 and second handle portion 220. The second adjustment portion 222 includes first and second side portions 224, 226 that form an elongated slot 228 there between. As illustrated in FIG. 9, the first side portion 224 includes teeth 230 that extend inwardly into the slot 228. However, it should be appreciated that teeth 230 may be disposed on the second side portion 226, or both of the respective first and second side portions 224, 226. In an embodiment, the teeth 230 are spaced at about 0.066 inches from one another and the elongated slot 228 is sized to provide a maximum jaw opening (i.e., distance between the first and second jaw portions 208, 218) of about 2.28 inches.

The second portion 204 is disposed in the slot 206 of the first portion 202, and the elongated slot 228 is aligned with an aperture 232 in the first adjustment portion 212 of the first portion 202. An adjustment member 234 couples the first and second portions 202, 204 together and forms a pivot point, allowing the first and second portions 202, 204 to pivot with respect to each other to open and close the first and second jaw portions.

Similar to the tool 100, the first portion 202 of the tool 200 may have an offset length of about 1.10 inches. Similarly, the second portion 204 may have an offset length of about 1.15 inches. The offset lengths provide at least about 0.50 inches of clearance between first and second handle portions 210, 220 in an area where a user's index finger contacts the first and second handle portions 210, 220. This reduces a chance of a user pinching his/her finger(s) or hand(s) between the first and second handle portions 210, 220 during use.

Figure 11:
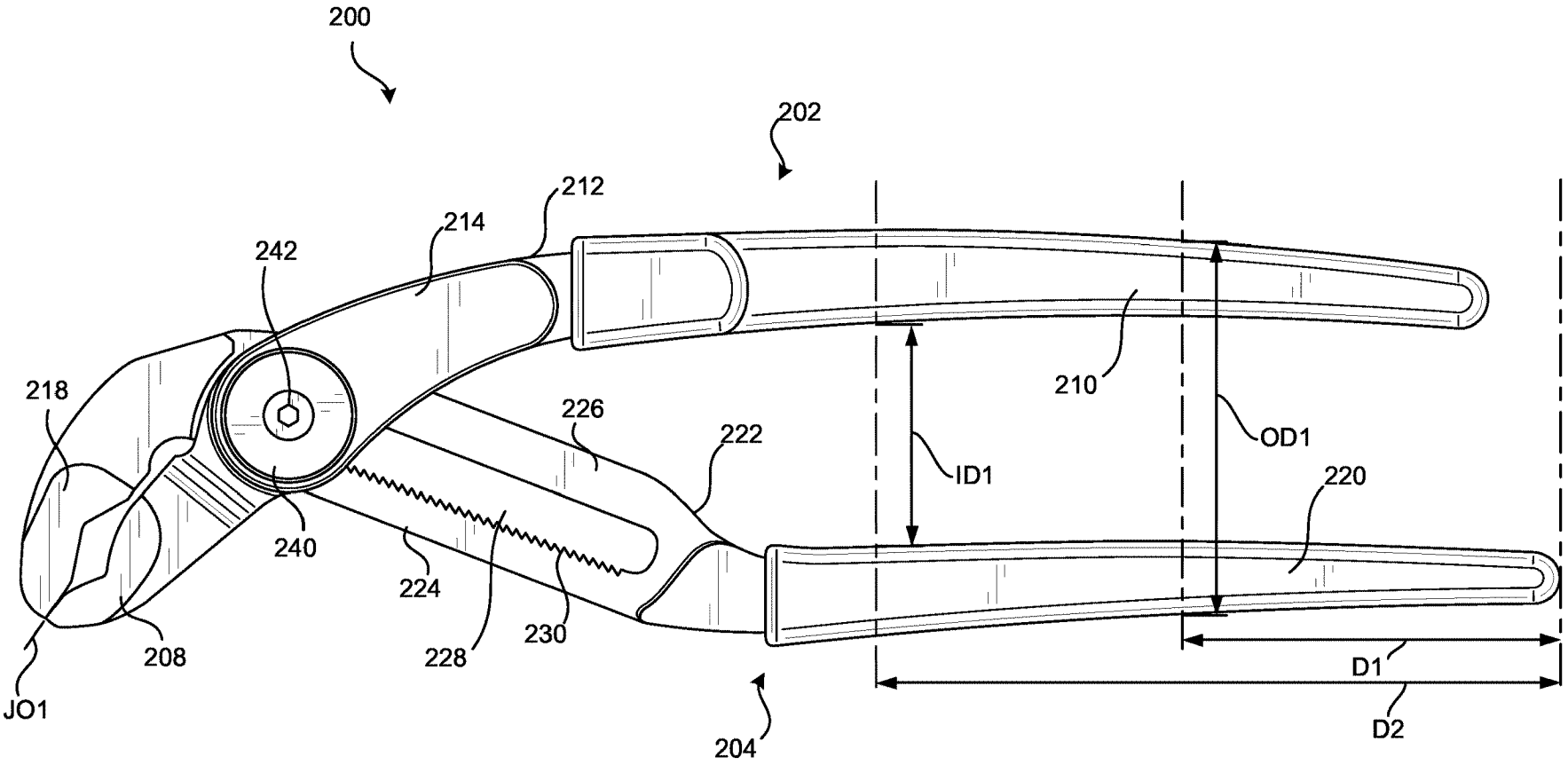
FIG. 11 is a second side view of the tool of FIG. 9 with jaws of the tool in the first position.

For example, referring to FIG. 11, the first and second jaw portions 208, 218 are in a first position. In the first position, the first and second jaw portions 208, 218 are closed, and have a first jaw opening distance (JO1) of about 0 inches. The first and second handle portions 210, 220 also have an outside distance (OD1) between exteriors sides of the first and second handle portions 210, 220 of about 2.45 inches, and an inside distance (ID1) between interior sides of the first and second handle portions 210, 220 of about 1.46 inches. As described above, the outside distance (OD1) is measured at a distance (D1) of about 2.5 inches from an end of the second handle portion 220, and the inside distance (ID1) is measured at a distance (D2) of about 4.2 inches from an end of the second handle portion 220.

Similar to the tool 100, when the first and second jaw portions 208, 218 are in a second position, with a second jaw opening distance of about 1.37 inches, the first and second handle portions 210, 220 may have an outside distance of about 2.32 inches and an inside distance of about 1.09 inches. When the first and second jaw portions 208, 218 are in a third position, with a third jaw opening distance of about 2.28 inches, the first and second handle portions 210, 220 may have an outside distance of about 1.94 inches and an inside distance of about 0.61 inches.

Accordingly, the offset lengths provide at least about 0.50 inches of clearance between first and second handle portions 210, 220 in an area where a user's index finger contacts the first and second handle portions 210, 220, in each of the first, second and third positions. This reduces a chance of a user pinching his/her finger(s) or hand(s) between the first and second handle portions 210, 220 during use.

Figure 12:
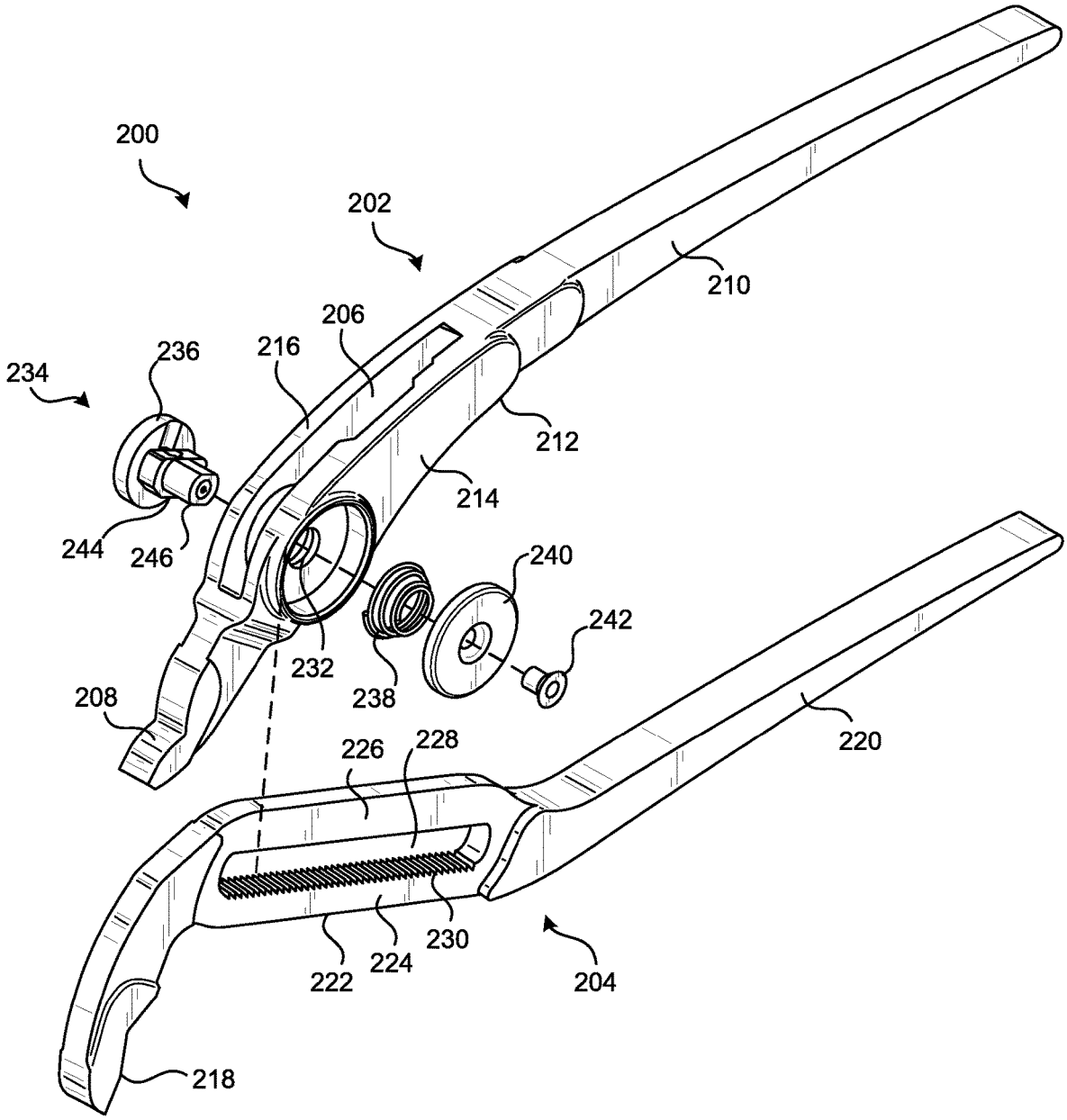
FIG. 12 is an exploded view of the tool of FIG. 9.

Referring to FIG. 12, the tool 200 also includes an adjustment member 234. The adjustment member includes a pawl 236, a bias member 238, a button 240, and a fastener 242. The pawl 236 includes teeth 244 adapted to mate with and engage teeth 230, and a fastener receiving portion 246 adapted to mate with the fastener 242. The pawl 236 is disposed in the aperture 232 adjacent an external surface of the second side portion 216. The pawl 236 may be keyed to the aperture to prevent rotation of the pawl 236 with respect to the first portion 202. The bias member 238 (which may be a spring) is disposed in a recess disposed in the first side portion 214. The button 240 is disposed adjacent the bias member 238 in the recess. The fastener 242 extends through the button 240 and bias member 238, and is coupled to the fastener receiving portion 246 of the pawl 236. The bias member 238 biases the button 240 and fastener 242 outwardly away from the first side portion 214, thereby causing the teeth 244 of pawl 236 to engage the teeth 230. When the button 240 is depressed against the bias force of the bias member 238, the teeth 244 of pawl 236 disengage the teeth 230.

In operation, a user may adjust the size of the opening between the first and second jaw portions 208, 218 by moving or sliding the first portion 202 with respect to the second portion 204 along elongated slot 228, or vice versa. This moves a pivot point between the first and second portions 202, 204 that is defined by the adjustment member 234. For example, to make a size of the opening smaller, the first portion 202 may be moved or slid to an end of the slot 228 proximal to the second jaw portion 218. When the size of the opening is made smaller, the teeth 244 of pawl 236 may ratchet with respect to the teeth 230, thereby allowing the size of the opening to be made smaller without having to depress the button. To make a size of the opening larger, the button may be depressed, thereby disengaging teeth 244 of pawl 236 from teeth 230. While the button is depressed, the first portion 202 may be moved or slid towards an end of the slot 228 distal to the second jaw portion 218.

The spacing of the teeth 244 may be about 0.066 inches or smaller, and the tool may provide a maximum jaw opening of about 2.28 inches. This provides more adjustment positions and allows more teeth 244 to be engaged with teeth 230 at all positions. For example, the size of the opening between the first and second jaw portions 208, 218 may be adjusted in 0.0.66 inch increments by moving or sliding the first portion 202 with respect to the second portion 204 along elongated slot 228.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a first portion having a first jaw portion and a first handle portion; and a second portion having a second jaw portion, a second handle portion, and an elongated slot disposed in the second portion between the second jaw portion and the second handle portion, the second portion is coupled to the first portion at a pivot point that is movable along the elongated slot, and the second jaw portion is aligned with the first jaw portion, wherein a first outer edge of the first handle portion is offset from the pivot point by a first length, and a second outer edge of the second handle portion is offset from the pivot point by a second length, wherein when the pivot point is moved along the elongated slot such that a distance between the first and second jaw portions is at a maximum opening, the first and second lengths provide at least about 0.50 inches of clearance between the first and second handle portions at a gripping area of the first and second handle portions.

2. The tool of claim 1, wherein the first length is about 1.10 inches.

3. The tool of claim 1, wherein the second length is about 1.15 inches.

4. The tool of claim 1, further comprising:

a first slot disposed in the first portion between the first jaw portion and the first handle portion.

5. The tool of claim 4, further comprising teeth disposed on the second portion proximal to or extending into the elongated slot.

6. The tool of claim 5, wherein the teeth are spaced with respect to one another at about 0.098 inches.

7. The tool of claim 5, wherein the maximum opening between the first and second jaw portions is about 2.24 inches.

8. The tool of claim 5, wherein the teeth are spaced with respect to one another at about 0.066 inches.

9. The tool of claim 5, wherein the maximum opening between the first and second jaw portions is about 2.28 inches.

10. The tool of claim 5, further comprising a pawl having pawl teeth, wherein the pawl is disposed adjacent to a first side of the first portion and extends into an aperture in the first portion, and the pawl teeth are adapted to engage the teeth disposed on the second portion.

11. The tool of claim 10, further comprising a button disposed adjacent to a second side of the first portion.

12. The tool of claim 11, further comprising a bias member disposed between the button and the second side of the first portion, wherein the bias member is adapted to bias the button outwardly away from the second side and the pawl teeth into engagement with the teeth disposed on the second portion.

13. The tool of claim 12, wherein depression of the button against a bias force of the bias member causes the pawl teeth to disengage from the teeth disposed on the second portion.

14. The tool of claim 4, wherein the elongated slot is formed by first and second side portions extending between the second handle portion and the second jaw portion.

* * * * *